United States Patent [19]

Saito et al.

[11] Patent Number: 4,620,507

[45] Date of Patent: Nov. 4, 1986

[54] STAVE COOLER

[76] Inventors: Hiromichi Saito, 4-8-1, Kuzuharahon-machi, Kokuraminami-ku, Kitakyushu-shi, Fukuoka-ken; Hiroto Arata, 207, Oaza Shimookuma, Nakama-shi, Fukuoka-ken; Kazuo Kimura, 3-6-21, Einomaruminami-machi, Yahatanishi-ku, Kitakyushu-shi, Fukuoka-ken; Kazuo Fujisawa, 5-12, Tenjin-machi, Yahatahigashi-ku, Kitakyushu-shi, Fukuoka-ken; Fumihiro Yamamoto, 2-6-1, Ichieda, Tobata-ku, Kitakyushu-shi, Fukuoka-ken, all of Japan

[21] Appl. No.: 353,386

[22] Filed: Mar. 1, 1982

[30] Foreign Application Priority Data

Mar. 6, 1981 [JP] Japan ..... 56-31286

[51] Int. Cl.[4] ..... C21B 7/10; F22B 37/00; B22D 19/00

[52] U.S. Cl. ..... 122/6 B; 266/193; 165/168; 165/180; 164/98; 164/102; 164/103

[58] Field of Search ..... 165/168, 169, 180; 122/6 A, 6 R, 6 B, 6 C, DIG. 13; 427/344, 374.4, 329; 138/145, 146; 266/190, 193; 164/103, 102, 100, 98

[56] References Cited

U.S. PATENT DOCUMENTS

| | | | |
|---|---|---|---|
| 1,025,817 | 5/1912 | Luckenbach | 164/100 |
| 1,333,151 | 3/1920 | Becket | 122/DIG. 13 |
| 1,527,538 | 7/1923 | Cox | 122/DIG. 13 |
| 1,689,279 | 10/1928 | Becket | 122/DIG. 13 |
| 1,763,421 | 6/1930 | De Vries | 122/DIG. 13 |
| 2,686,355 | 8/1954 | Lundin | 427/329 |
| 3,706,343 | 12/1972 | Saiga et al. | 165/70 |
| 3,822,736 | 7/1974 | Andoniev et al. | 164/100 |
| 3,853,309 | 12/1974 | Widmer | 165/180 |
| 3,888,297 | 6/1975 | Davies | 164/103 |
| 4,023,613 | 5/1977 | Uebayasi et al. | 164/100 |
| 4,150,818 | 4/1979 | Buhler | 266/193 |
| 4,162,061 | 7/1979 | Buhler | 266/193 |
| 4,217,954 | 8/1980 | Vincent | 266/193 |
| 4,327,899 | 5/1982 | Suzuki et al. | 165/70 |
| 4,335,870 | 6/1982 | Diener et al. | 165/168 |

FOREIGN PATENT DOCUMENTS

| | | | |
|---|---|---|---|
| 2804745 | 1/1983 | Fed. Rep. of Germany | 266/190 |
| 0041966 | 12/1979 | Japan | 266/193 |

*Primary Examiner*—William R. Cline
*Assistant Examiner*—John K. Ford

[57] ABSTRACT

A cast steel stave cooler comprising a carbon steel cooling pipe having a roughened surface and having a coating thereon, and a cast steel embedding the cooling pipe therein. The cast steel contains 10 to 25% Cr and has a very reduced liquid-solid zone so as to prevent fusion of the cooling pipe during the casting. The cooling pipe is provided with fins which are integratedly welded to the cast steel.

32 Claims, 6 Drawing Figures

STAVE COOLER

BACKGROUND OF THE INVENTION

1. Field of the Invention

The present invention relates to stave coolers used for cooling, for example, hearth walls of blast furnaces, etc.

2. Description of the Prior Arts

Generally speaking, the life of a blast furnace using stave coolers is said to depend on the durability of the staves.

However, up-to-date the staves are made of low-melting point, fragile cast iron and thus are quite susceptible to severe damages due to fusion, thermal crackings, high-temperature wearing and the like. The wear of staves is caused by a peculiar phenomenon that the graphite flake (kish graphite) in the stave cast iron is attacked by $CO_2$, $SO_2$, $K_2O$, etc. contained in the furnace gas to form a plate-like, fragile defect portion attacked like an ant nest in the stave cast iron, so that the stave is easily damaged due to wearing or cracking caused by the furnace charges.

Therefore, in order to reduce the wearing rate of the staves, it is essential that a heat resistant cast steel free from the graphite is used as the stave material.

However, there is another problem that the melting point of the cast steel is remarkably different from that of the cast iron. The cast iron can be easily cast at a relatively low temperature ranging from 1300° C. to 1350° C. so that the cast iron stave is substantially free from the problem of fusion of pipes embedded in the staves and the pipes can be consistently and safely cast in the staves. On the other hand, the cast steel must be cast at about 1550° C., and requires risers (sink heads) for preventing shrinkage during the casting operation. The portion provided with the riser is delayed in solidification so that the fusion of the cooling pipes in this portion is caused.

In order to prevent the fusion of the cooling pipes, it is necessary to increase the thickness of coatings applied on the cooling pipes. This not only leads to remarkable lowering of cooling capacity of resultant cooling staves, but also increases the tendency of stripping-off of the coatings due to the thermal shocks during the casting operation and considerably promotes the pipe fusion so that the staves can not be consistently produced.

For these reasons, a stave made of cast steel has never been practically made or used in the blast furnace.

SUMMARY OF THE INVENTION

Therefore, one of the objects of the present invention is to provide stave coolers which are free from the above problems and difficulties.

Another object of the present invention is to provide a method for producing such stave coolers.

The gist of the present invention lie in that the stave is made of a specific steel composition which is very advantageous for preventing the fusion of pipes during the casting operation due to substantial freedom from the co-existence of a solid phase and a liquid phase (solid-liquid zone) and which can reduce the wearing rate of the stave, and in that the surface of the pipes to be embedded is roughened preliminarily for the purpose of increasing the adhesion of the coatings to the pipe surface, and the coatings are applied at relatively high temperatures so as to prevent the stripping-off of the coatings on the pipes due to the thermal shocks during the casting operation, thus enabling the commercial production of stave coolers made of heat-resistant cast steel.

BRIEF EXPLANATION OF THE DRAWINGS

FIG. 2(*b*) shows a modification of the studs.

DETAILED DESCRIPTION OF THE INVENTION

Figure 1A:
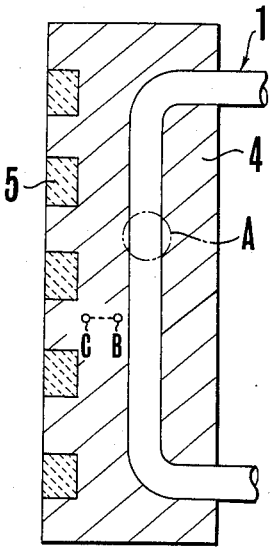
FIGS. 1(*a*) and (*b*) show the inside structure of a stave cooler according to the present invention, in which a cooling pipe without studs is embedded in cast steel.

In the case of a cast steel stave, the solidification temperature of the cast steel is high and normally a pouring temperature as high as 1550° C. is required for casting, which is about 300° C. higher than in the case of a cast iron stave. Therefore, in the case of a cast steel stave, it is found that when the volume of the material to be embedded is 3% or less of the volume of the molten steel, the material is fused. In the case of a steel pipe, the pipe is easily heated and there is a greater tendency of fusion, because of the low thermal conductivity of air contained in the hollow portion of the pipe. In the stave cooler, as the volume of the pipe to the volume of the stave material is normally not larger than 3%, it is necessary to take some measures for preventing the fusion.

The present inventors have investigated the fusion mechanism of the pipes when embedded in the staves, and found the following facts.

The heat energy which contributes to the fusion is mainly that obtained at temperatures above the completion of the solidification of cast iron or steel, and the cast steel has a temperature zone in which the solid phase and the liquid phase co-exist due to the presence of C, Si, Mn and other alloying elements. In this temperature zone, the solidification speed is lowered by the emission of the solidification latent heat, during which the coating on the pipe surface is made fragile and is peeled off so that the pipe is fused by the inter-diffusion of the iron atoms between the pipe and the molten metal. Therefore, when steel pipes are embedded in cast steel, an increased thickness of the coating on the pipe is required, which in turn remarkably lowers the cooling capacity of the stave, thus failure to achieve the desired result. Also when the thickness of the coating is increased, the coating is more apt to be cracked by thermal shocks during the casting operation.

It has been further found that the solidification delay caused by the provision of a riser promotes the fusion of the pipe.

In order to eliminate the adverse facts as described above, it is necessary to lower the casting temperature as low as possible, and to reduce the solid-liquid zone as little as possible, so as to reduce the diffusion rate of iron atoms.

From the aspect of materials, it has been found that the solid-liquid zone varies depending on the Cr contents, and 10% to 25% Cr which substantially eliminates the solid-liquid zone is selectively used in the present invention for overcoming the problem.

It has been also found that chromium can reduce the inter-diffusion of the iron atoms and is effective to provide excellent heat resistance and wear resistance required as the stave cooler.

Carbon, on the other hand, relatively increases the solid-liquid zone when contained in an increased amount, and from the aspect of the material quality, carbon contents of 0.7% or higher cause precipitation of ferrite or carbides at the grain boundaries, resulting in material deterioration. As the material for stave coolers is required to have wear resistance, heat resistance and crack resistance so as to reduce the wearing away of the stave coolers, the carbon content should be maintained not larger than 0.7% in view of its tendency of increasing the solid-liquid zone. Regarding other elements, there is no specific limitation and they may be present in amounts as found in ordinary steels. However, silicon should be desirably maintained not larger than 1.0% because it has a remarkable tendency to increase the solid-liquid zone width.

Thus the cast steel used in the present invention may contain 0.05 to 0.7% C, 0.1 to 2.0% Si, 0.1 to 2.0% Mn, 0.005 to 0.08% P, 0.05 to 0.080% S, 10 to 25% Cr with the balance being iron and unavoidable impurities.

It is also quite important to prevent the peelingoff of the coating on the pipe due to the thermal shocks during the casting operation by increasing the adhesion force between the pipe surface and the coating. The adhesion depends on the undulation of the pipe surface, the temperature at which the coating is applied, the coating material, the particle size of the coating material, and the thickness of the coating to be applied on the pipe.

As the coating material, zircon, alumina and chamotte are desirable, and from the aspect of the cooling capacity, zircon is most desirable.

For a better adhesion of the coating, it is desirable to preliminarily heat the pipe at temperatures ranging from 100° C. to 300° C. and to apply the coating by spraying.

Figure 1B:
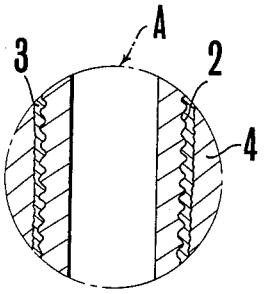

Various methods are available for roughening the pipe surface, and as shown in FIG. 1(*a*) when the pipe surface is undulated by notches or by shot-blasting or grit-blasting, excellent prevention of the peeling-off of the coating can be obtained so that the pipe can be easily embedded in the stave.

Regarding the thickness of the coating to be applied on the pipe, 0.3 mm to 0.7 mm is desirable.

Figure 2A:
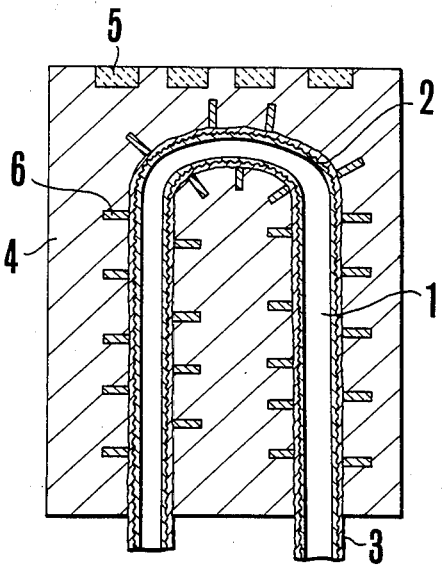
FIG. 2(*a*) shows the inside structure of a modified stave cooler according to the present invention, in which the cooling pipe with studs is embedded.
Figure 2B:
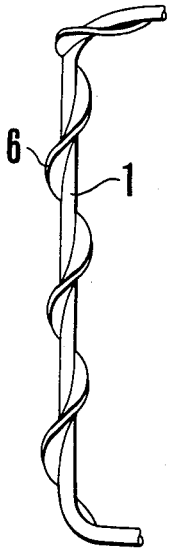

For increasing the cooling power of the cooling pipe so as to further improve the cooling capacity of the stave made of heat-resistant cast iron, thereby improving the service life of the stave and reducing the required thickness of the stave and the production cost, metallic projections such as studs may be arranged continuously or discontinuously on the outer surface of the cooling pipe as shown in FIG. 2(*a*), and the pipe with such projections is preheated and applied with the coating, and embedded. When molten steel is cast around the coated cooling pipe, there is formed a space between the cast steel and the pipe after the solidification of the cast steel, so that the cooling pipe is in the non-welded condition to the cast steel, while the projections are welded to the cast steel, because the projections have no coating. In this way, the wearing of the stave can be reduced, the fusion loss of the cooling pipe can be prevented and the durability of the stave cooler can be improved.

Regarding the cooling pipe, ordinary carbon steel pipes may be used and it is to use a carbon steel pipe for pressure service having a composition containing 0.08 to 0.15% C, 0.18 to 0.24% Si, 0.3 to 0.60% Mn, not larger than 0.035% P, and not larger than 0.35% S. The general steel composition for carbon steel pipes for pressure services is specified by JIS G-3454. Regarding the wall thickness of the cooling pipe, 5 mm or larger thickness is desirable.

DESCRIPTION OF PREFERRED EMBODIMENTS

The present invention will be more clearly understood from the following description of preferred embodiments.

FIGS. 1(*a*) and (*b*) respectively illustrate a stave cooler according to the present invention, in which the cooling pipe 1 having an undulated surface 2 is applied with the coating 3 and is embedded in the cast steel 4. The stave is supported on the furnace bricks 5.

The cast steel 4 contains 0.31% C, 0.54% Si, 0.61% Mn, 0.019% P, 0.014% S and 16.7% Cr, with an extremely reduced solid-liquid zone and excellent heat resistance and wear resistance.

The steel pipe 1 has a wall thickness of 6 mm and the surface is undulated by grinding. The steel pipe having the undulated surface is pre-heated to about 300° C. and applied with the zircon coating 3 about 0.3 mm thick.

The cooling pipe 1 thus coated is set in a mold (not shown) and cast steel having the composition stated hereinbefore is cast around the pipe at a temperature ranging from 1530° C. to 1560° C. to obtain a stave cooler.

The resultant stave cooler shows no fusion of the cooling pipe embedded therein and a very long service life.

In FIGS. 2(*a*) and (*b*), showing another embodiment of the present invention, the cooling pipe 1 has an undulated surface 2, and applied with a coating just as shown in FIG. 1. In this embodiment, however, the cooling pipe has a plurality or projections or steel studs projecting from the pipe surface. The cast steel 4 in this embodiment contains 0.31% C, 0.54% Si, 0.61% Mn, 0.019% P, 0.014% S and 16.7% Cr. The surface of the cooling pipe is undulated (2) by shot-blasting. The studs 6 are welded to the pipe surface and arranged discontinuously as shown in FIG. 2(*a*) or welded in the form of continuous fin around the pipe surface as is shown in FIG. 2(*b*).

Before embedment, the cooling pipe is preheated to about 300° C. and applied with the zircon coating 3 about 0.3 mm thick. The pipe thus coated and having the studs is set in a mold (not shown) and cast steel having the composition stated hereinbefore is cast around the pipe and the studs at a temperature ranging from 1530° C. to 1560° C. In this way, the studs are welded directly to the cast steel, while the cooling pipe is embedded in non-welded condition to the cast steel due to the presence of the coating.

Figure 3:
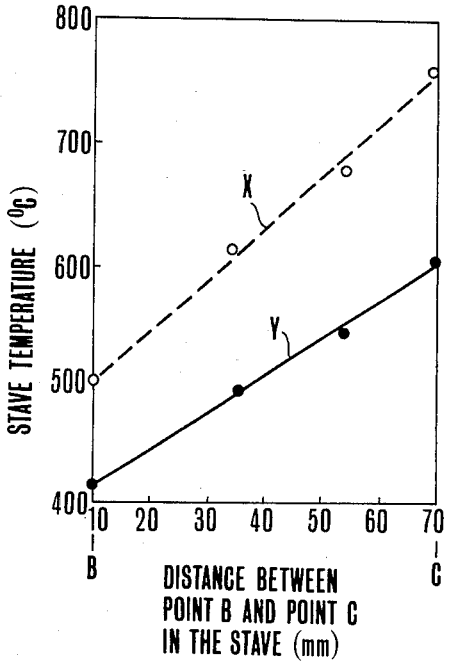
FIG. 3 is a graph showing the temperature distribution in the stave cooler according to the present invention as compared with that in a conventional stave cooler.
Figure 4:
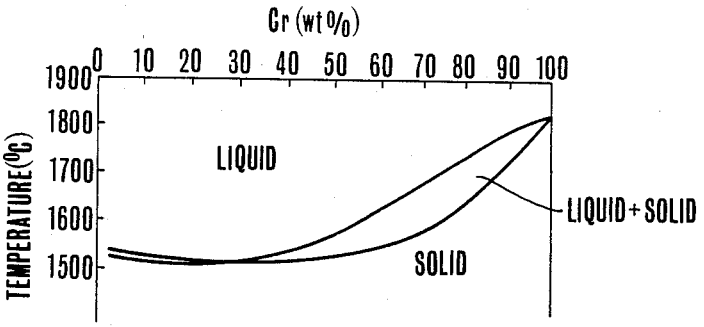
FIG. 4 shows the effect of Cr contents on the solid-liquid zone.

The stave coolers according to the embodiments were inserted in a furnace at about 900° C. and cooled by passing the cooling water at 25° C. with a flowing rate of 90 l/min. per one pipe just as for cooling the conventional stave coolers. The resultant temperature distribution produced in the stave portions excluding the pipe portions is shown in FIG. 3. As compared with the conventional stave cooler X (without the studs), the stave cooler Y according to the present invention shows a cooling difference ranging from about 100° C. to 150° C. between the point B and the inward point C shown in FIG. 1(*a*). This indicates that the cooling capacity of the stave is increased, and the temperature rise in the stave can be minimized so that the cracks and wearings can be effectively prevented, and even if crack is caused in the corner portions of the stave, the projections or studs can effectively prevent the fall down of the cracked portions.

As understood from the foregoing description, the stave cooler according to the present invention has remarkable advantages that it shows remarkably improved heat resistance, wear resistance and thermal crack resistance over the conventional cast iron stave coolers and the wear rate is greatly reduced hence elongating the service life of a blast furnace.

What is claimed is:

1. A stave cooler comprising a carbon steel cooling pipe having an undulating roughened surface and having a coating of a material selected from the group consisting of zircon, alumina, and chamotte thereon, and a cast steel for preventing fusion damage embedding the cooling pipe therein, said cast steel containing not more than 0.7% C and 10% to 25% Cr.

2. A stave cooler according to claim 1 comprising a carbon steel cooling pipe having an undulating roughened surface and said coating comprising alumina thereon, and said cast steel embedding the cooling pipe therein, said cast steel containing not larger than 0.7% C and 10% to 25% Cr.

3. A stave cooler according to claim 2, in which the cast steel consists essentially of:

C: 0.05–0.7%
Si: 0.1–2.0%
Mn: 0.1–2.0%
P: 0.005–0.080%
S: 0.05–0.080%
Cr: 10–25%
Fe: balance.

4. A stave cooler according to claim 2, in which the cooling pipe has a metallic projection arranged on its outer surface.

5. A stave cooler according to claim 2, in which the cooling pipe has a 0.3 mm to 0.7 mm thick coating of alumina on its outer surface and has a wall thickness not less than 5 mm.

6. A stave cooler according to claim 4, in which the metallic projection comprises a plurality of separate fins projecting from the surface of the cooling pipe.

7. A stave cooler according to claim 4, in which the metallic projection is a spiral continuous fin surrounding the surface of the cooling pipe.

8. A stave cooler according to claim 2 wherein the coating on the cooling pipe has a thickness of 0.3 mm to 0.7 mm.

9. A stave cooler according to claim 1 comprising a carbon steel cooling pipe having an undulating roughened surface and said coating comprising chamotte thereon, and said cast steel embedding the cooling pipe therein, said cast steel containing not larger than 0.7% C and 10% to 25% Cr.

10. A stave cooler according to claim 9, in which the cast steel consists essentially of:

C: 0.05–0.7%
Si: 0.1–2.0%
Mn: 0.1–2.0%
P: 0.005–0.080%
S: 0.05–0.080%
Cr: 10–25%
Fe: balance.

11. A stave cooler according to claim 9, in which the cooling pipe has a metallic projection arranged on its outer surface.

12. A stave cooler according to claim 9, in which the cooling pipe has a 0.3 mm to 0.7 mm thick coating of chamotte on its outer surface and has a wall thickness not less than 5 mm.

13. A stave cooler according to claim 11, in which the metallic projection comprises a plurality of separate fins projecting from the surface of the cooling pipe.

14. A stave cooler according to claim 11, in which the metallic projection is a spiral continuous fin surrounding the surface of the cooling pipe.

15. A stave cooler according to claim 9 wherein the coating on the cooling pipe has a thickness of 0.3 mm to 0.7 mm.

16. A stave cooler comprising a carbon steel cooling pipe having an undulating roughened surface and having a coating comprising zircon, thereon, and a cast steel embedding the cooling pipe therein, said cast steel for preventing fusion damage containing not larger than 0.7% C and 10% to 25% Cr.

17. A stave cooler according to claim 16, in which the cast steel consists essentially of:

C: 0.05–0.7%
Si: 0.1–2.0%
Mn: 0.1–2.0%
P: 0.005–0.080%
S: 0.05–0.080%
Cr: 10–25%
Fe: balance.

18. A stave cooler according to claim 16, in which the cooling pipe has a metallic projection partially welded thereto arranged on its outer surface.

19. A stave cooler according to claim 16, in which the cooling pipe has a 0.3 mm to 0.7 mm thick coating of zircon on its outer surface and has a wall thickness not less than 5 mm for preventing fusion loss.

20. A stave cooler according to claim 18, in which the metallic projection partially welded thereto comprises a plurality of separate fins projecting from the surface of the cooling pipe.

21. A stave cooler according to claim 18, in which the metallic projection partially welded thereto is a spiral continuous fin surrounding the surface of the cooling pipe.

22. A stave cooler according to claim 16 wherein the coating on the cooling pipe has a thickness of 0.3 mm to 0.7 mm for preventing fusion loss.

23. A method for manufacturing a stave cooler, which comprises the steps of roughening the surface of a carbon steel cooling pipe to be embedded, preheating the cooling pipe, applying a coating comprising a material selected from the group consisting of zircon, alumina, and chamotte on the surface of the cooling pipe, and casting a molten steel containing not more than 0.7% C and 10 to 25% Cr for preventing fusion loss around the pipe.

24. A method for manufacturing a stave cooler according to claim 23, which comprises the steps of roughening the surface of a carbon steel cooling pipe to be embedded, preheating the cooling pipe, applying a coating comprising alumina on the surface of the cooling pipe, and casting a molten steel containing not larger than 0.7% C and 10 to 25% Cr around the pipe.

25. A method according to claim 24, in which a metallic projection is arranged on the surface of the cooling pipe, and the molten steel is cast around the coated cooling pipe and the projection.

26. A method according to claim 24, in which the cooling pipe is preheated to 100° C. to 300° C.

27. A method for manufacturing a stave cooler according to claim 23, which comprises the steps of roughening the surface of a carbon steel cooling pipe to be embedded, preheating the cooling pipe, applying a coating comprising chamotte on the surface of the cooling pipe, and casting a molten steel containing not larger than 0.7% C and 10 to 25% Cr around the pipe.

28. A method according to claim 27, in which a metallic projection is arranged on the surface of the cooling pipe, and the molten steel is cast around the coated cooling pipe and the projection.

29. A method according to claim 27, in which the cooling pipe is preheated to 100° C. to 300° C.

30. A method for manufacturing a stave cooler, which comprises the steps of roughening the surface of a carbon steel cooling pipe to be embedded, preheating the cooling pipe, applying a coating comprising zircon on the surface of the cooling pipe, and casting a molten steel containing not larger than 0.7% C and 10 to 25% Cr for preventing fusion loss around the pipe.

31. A method according to claim 30, in which a metallic projection partially welded thereto is arranged on the surface of the cooling pipe, and the molten steel is cast around the coated cooling pipe and the projection.

32. A method according to claim 30, in which the cooling pipe is preheated to 100° C. to 300° C.

* * * * *